US011187061B2

(12) United States Patent
Glaser

(10) Patent No.: US 11,187,061 B2
(45) Date of Patent: Nov. 30, 2021

(54) INTELLIGENT LANDING PROFILE

(71) Applicant: Halliburton Energy Services, Inc., Houston, TX (US)

(72) Inventor: Mark C. Glaser, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/080,882

(22) PCT Filed: Nov. 13, 2017

(86) PCT No.: PCT/US2017/061289
§ 371 (c)(1),
(2) Date: Aug. 29, 2018

(87) PCT Pub. No.: WO2019/094041
PCT Pub. Date: May 16, 2019

(65) Prior Publication Data

US 2021/0123328 A1 Apr. 29, 2021

(51) Int. Cl.
*E21B 43/10* (2006.01)
*E21B 23/02* (2006.01)
(Continued)

(52) U.S. Cl.
CPC ..... *E21B 43/103* (2013.01); *E21B 23/02* (2013.01); *E21B 33/12* (2013.01); *E21B 33/14* (2013.01)

(58) Field of Classification Search
CPC ..... E21B 43/103; E21B 23/02; E21B 33/12; E21B 33/14
See application file for complete search history.

(56) References Cited

U.S. PATENT DOCUMENTS 4,949,786 A 8/1990 Eckert et al.
6,012,527 A * 1/2000 Nitis ..... E21B 7/061 166/313
(Continued)

FOREIGN PATENT DOCUMENTS

EP 2159370 A2 3/2010
WO WO 2015-192226 A1 12/2015
WO WO 2017-007476 A1 1/2017

OTHER PUBLICATIONS

International Search Report and The Written Opinion of the International Search Authority, or the Declaration, dated Aug. 2, 2018, PCT/US2017/061289, 19 pages, ISA/KR.
(Continued)

*Primary Examiner* — Yong-Suk (Philip) Ro
(74) *Attorney, Agent, or Firm* — Haynes and Boone, LLP

(57) ABSTRACT

A method for securing a downhole assembly to a casing string disposed within a wellbore includes moving, in a first direction, at least a portion of the downhole assembly within a passageway of a landing nipple that forms a portion of the casing string; exchanging a wireless signal between a first communication device that is coupled to the downhole assembly and a second communication device that forms a portion of the nipple; and preventing further movement of the downhole assembly, relative to the nipple, in the first direction in response to the exchange of the wireless signal and when the first communication device is spaced from the second communication device in the first direction.

20 Claims, 7 Drawing Sheets

(51) Int. Cl.
*E21B 33/12* (2006.01)
*E21B 33/14* (2006.01)

(56) References Cited

U.S. PATENT DOCUMENTS

| | | | | |
|---|---|---|---|---|
| 6,863,129 | B2 | 3/2005 | Ohmer et al. | |
| 8,579,504 | B2 | 11/2013 | Koeniger et al. | |
| 9,512,697 | B2 | 12/2016 | Pike | |
| 2008/0223572 | A1 | 9/2008 | Vert et al. | |
| 2009/0101345 | A1 | 4/2009 | Moffitt et al. | |
| 2015/0275620 | A1* | 10/2015 | Scott | E21B 34/08 166/53 |
| 2016/0130919 | A1* | 5/2016 | Vasques | E21B 33/126 166/381 |
| 2016/0305232 | A1 | 10/2016 | Bird et al. | |
| 2017/0122042 | A1 | 5/2017 | Travis et al. | |

OTHER PUBLICATIONS

Matanovic et al., "Downhole and Surface Equipment", Springer, 2012, pp. 171-193.

* cited by examiner

INTELLIGENT LANDING PROFILE

PRIORITY

The present application is a U.S. National Stage patent application of International Patent Application No. PCT/US2017/061289, filed on Nov. 13 2017, the benefit of which is claimed and the disclosure of which is incorporated herein by reference in its entirety.

TECHNICAL FIELD OF THE DISCLOSURE

This disclosure relates, in general, to equipment utilized in conjunction with operations performed in relation to subterranean wells and, in particular, to an intelligent landing profile for installing a liner string within a casing string in a subterranean wellbore.

BACKGROUND

Casing landing profiles are often are formed within a portion of the casing string. The casing landing profile generally mates with a downhole tool, such as a liner hanger, to secure the liner hanger longitudinally within the casing string. Casing landing profiles are prone to collecting cement and other debris prior to the installation of a completion subassembly that includes the liner hanger. Thus, a cleaning trip is often required to attempt to adequately remove the debris before the liner hanger is installed. The necessity of a 'clean' profile is increased when there is no No-Go present in the casing landing profile. A casing landing profile that includes a No-Go also generally reduces the inner diameter of the casing land profile. Thus, a casing landing profile without a No-Go is often preferred due to the preference for unobstructed wellbore with casing drift and to avoid the necessity of a 'clean' profile. However, pipe manipulation is often required when the liner hanger is landed in a landing profile that does not have a No-Go. When there are control lines and other equipment attached to the liner, this pipe manipulation can result in damage to the lines.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
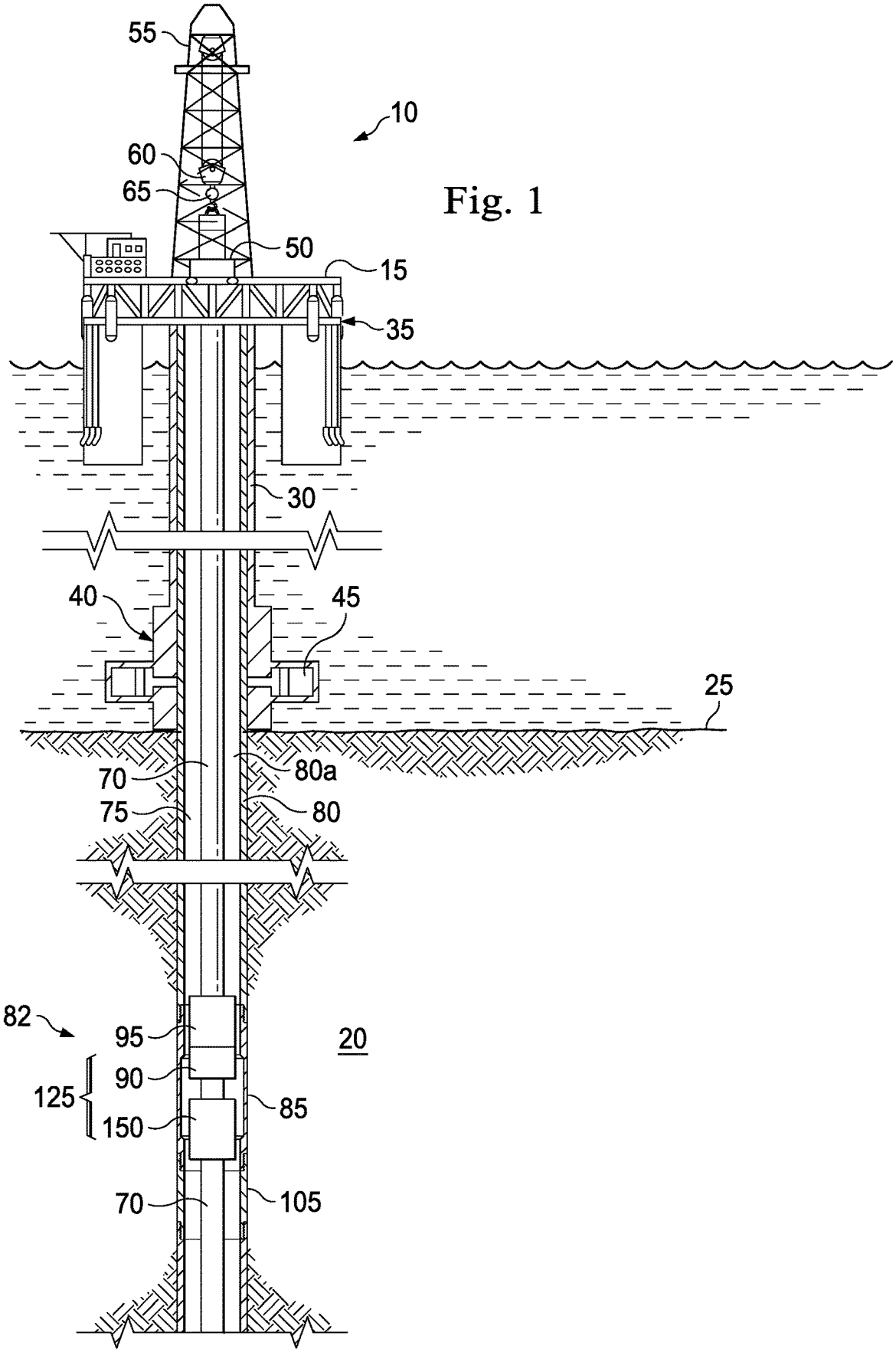
FIG. 1 is a schematic illustration of an oil and gas rig coupled to an intelligent landing profile, a running tool, and a liner hanger, according to an embodiment of the present disclosure.

Illustrative embodiments and related methods of the present disclosure are described below as they might be employed in an intelligent landing profile and method of operating the same. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" may encompass both an orientation of above and below. The apparatus may be otherwise oriented (rotated 90 degrees or at other orientations) and the spatially relative descriptors used herein may likewise be interpreted accordingly.

FIG. 1 is a schematic illustration of an offshore oil and gas platform generally designated 10, operably coupled by way of example to an intelligent landing profile according to the present disclosure. Such an intelligent landing profile could alternatively be coupled to a semi-sub or a drill ship as well. Also, even though FIG. 1 depicts an offshore operation, it should be understood by those skilled in the art that the apparatus according to the present disclosure is equally well suited for use in onshore operations. By way of convention in the following discussion, though FIG. 1 depicts a vertical wellbore, it should be understood by those skilled in the art that the apparatus according to the present disclosure is equally well suited for use in wellbores having other orientations including horizontal wellbores, slanted wellbores, multilateral wellbores or the like.

Referring still to the offshore oil and gas platform example of FIG. 1, a semi-submersible platform 15 may be positioned over a submerged oil and gas formation 20 located below a sea floor 25. A subsea conduit 30 may extend from a deck 35 of the platform 15 to a subsea wellhead installation 40, including blowout preventers 45. The platform 15 may have a hoisting apparatus 50, a derrick 55, a travel block 60, a hook 65, and a swivel for raising and lowering pipe strings, such as a substantially tubular, axially extending tubing string 70.

As in the present example embodiment of FIG. 1, a wellbore 75 extends through the various earth strata including the formation 20, with a portion of the wellbore 75 having a casing string or casing 80 cemented therein. At least a portion of an intelligent landing assembly 82 is formed within the casing string 80. The casing 80 may form a passageway 80*a*. The intelligent landing assembly includes a tubular landing nipple 85 or other tool having a landing profile which forms a portion of the casing 80 and a portion of the passageway 80*a*. The intelligent landing assembly 82 also includes a liner hanger 90, or other tool such as a packer, whipstock, tubing hanger, artificial lift equipment, tubing anchor, etc. that is configured to be secured to the casing 80 using the nipple 85. A running tool 95 is often coupled between a portion of the tubing string 70 and the liner hanger 90 to run the liner hanger 90 downhole and install the liner hanger 90 in the nipple 85. The liner hanger 90 and the running tool 95 together form a downhole assembly and the liner hanger 90 alone is a downhole assembly. In one embodiment, the nipple 85 is a casing coupling with an internal profile that mates with the liner hanger 90 or other tool. Generally, the term "casing" is used herein to designate a tubular string operable to be positioned in a wellbore to provide wellbore stability. The casing may be of the type known to those skilled in the art as a "liner" and may be made of any material, such as steel or a composite material. The casing may be a jointed tubular string or a continuous tubular string.

Figure 2:
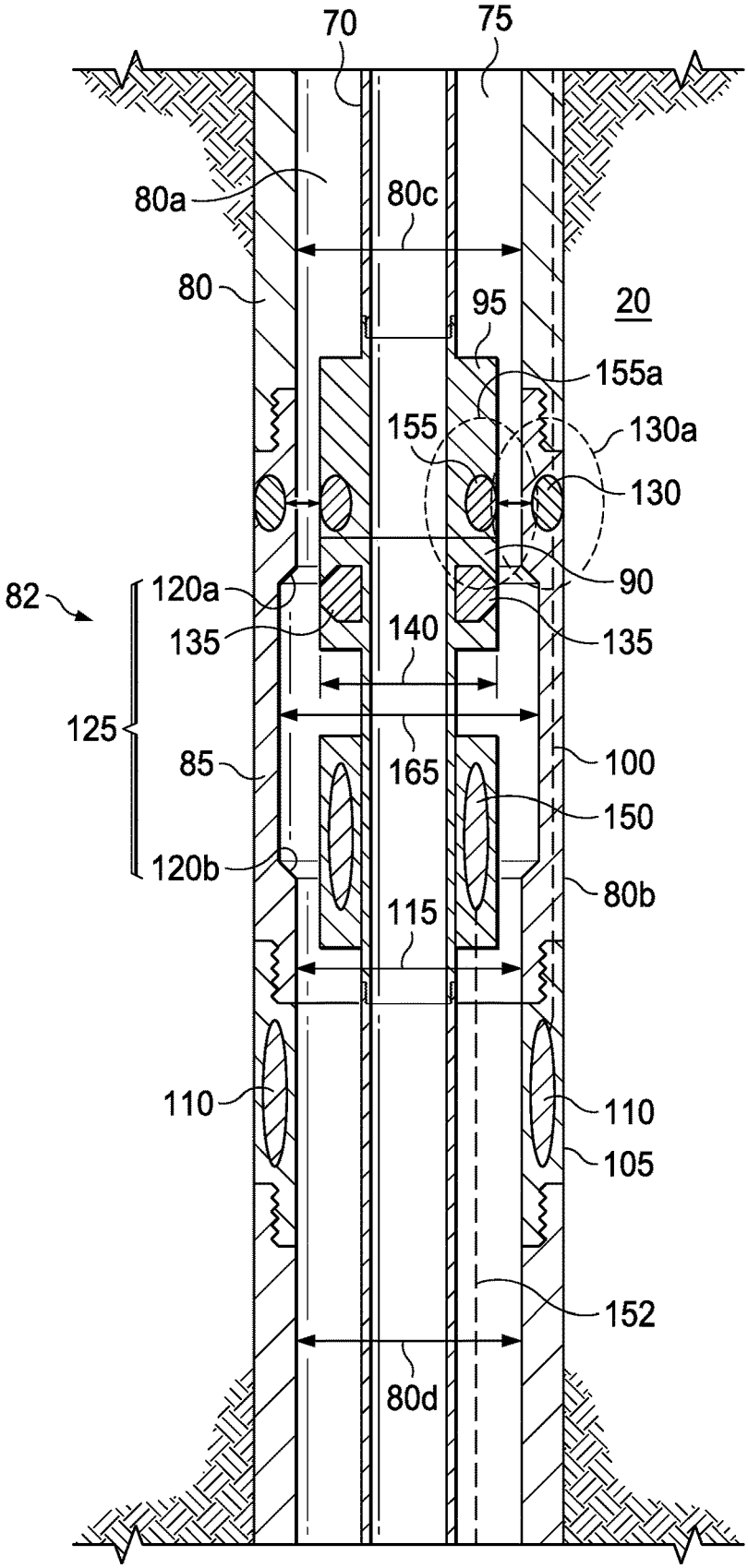
FIG. 2 illustrates a sectional view of the running tool, the intelligent landing profile, and the liner hanger of FIG. 1 in a wellbore in a first configuration, according to one embodiment of the present disclosure.

FIG. 2 illustrates a cross section of the running tool 95, the liner hanger 90, and the nipple 85. In one embodiment and as illustrated in FIG. 2, the nipple 85 forms a portion of the casing string 80 and can be threaded or otherwise attached to directly upper and directly lower sections, relative to the nipple 85, of the casing string 80. In some embodiments, the nipple 85 includes control lines 100 that are run on the exterior 80*b* of the casing 80 or within a wall of the casing 80. Generally, the control lines 100 extend from the surface of the well and terminate in a connection sub 105 which itself can be integral with, or separate from (as shown in FIGS. 2-5), the nipple 85. The connection sub 105 includes one or more connections 110, which may include for example, an inductive coupler, an electrical connection, a hydraulic connection, or any other energy transfer mechanism, and/or a fibre optic connection. These connections 110 can require precise axial alignment with corresponding connections for optimal performance and tool simplification. The nipple 85 has an inner diameter 115 that is substantially similar (within +/−5%) to an inner diameter 80*c* of the casing string 80 that is associated with a casing coupled uphole from the nipple 85 and an inner diameter 80*c* of the casing string 80 that is associated with a casing coupled downhole from the nipple 85. The nipple 85 also forms two opposing annular shoulders 120*a* and 120*b* that are longitudinally spaced, between which a recess or an enlarged inner diameter portion 125 of the nipple 85 extends. Generally, the enlarged inner diameter portion 125 forms a longitudinally extending, annular recess in a wall of the nipple 85. The nipple 85 also includes a communication device 130 located within or secured to the wall of the nipple 85. The communication device 130 may be an inductive coupler or the like. Generally, the communication device 130 is located such that it can communicate or couple to a downhole tool that extends within the nipple 85. As shown, the communication device 130 is located above or uphole from the uppermost shoulder 120*a*. However, in other embodiments the communication device 130 can be located in a variety of locations along the nipple 85 such as for example, downhole or below the uppermost shoulder 120*a* and above the shoulder 120*b*.

In one embodiment, the liner hanger 90 includes radially extendable and retractable arm or dog elements 135 that are retractable and extendable in a radial direction with respect to a longitudinal axis of the liner hanger 90. When the dog elements 135 are in the retracted position, the liner hanger 90 is in a retracted position and has an outer diameter 140. In an extended position, the dog elements 135 extend radially beyond the outer diameter 140 to form an outer diameter 145 (shown in FIG. 3) that is greater than the outer diameter 140. In one embodiment, the liner hanger 90 includes connections 150, which may include for example, an inductive coupler, an electrical connection, a hydraulic connection, and/or a fibre optic connection. Control lines 152 extend from the connections 150 and downhole to completion equipment, etc. These connections 150 compliment or correspond to the connections 110 of the nipple 85. In one embodiment, the connections 150 are spaced from the dog elements 135 in the downhole direction. However, in instances, the connections 150 can be located in a variety of locations along the liner hanger 90.

In one embodiment, the running tool 95 is coupled to or otherwise attached to the tubing string 70. The running tool 95 detachably couples to the liner hanger 90 to run the liner hanger 90 downhole. In some embodiments, the running tool 95 includes a communication device 155 that is longitudinally and radially located such that it can communicate or couple to the communication device 130 of the nipple 85. As shown, the communication device 155 is located at a lower end of the running tool 95. The communication device 155 may be an inductive coupler, or the like, that is capable of wireless power transmission and/or wireless data transmission. The running tool 95 may include any number of communication devices 155. Generally, the communication devices 130 and 155 have transmission ranges 130*a* and 155*a*, respectively, in which a signal or signals can be exchanged to transmit energy and/or data. The communication devices 130 and 155 are positioned relative to the enlarged inner diameter portion 125 and the dog elements 135, respectively, such that the dog elements 135 are positioned within the portion 125 prior to, upon, or directly after the ranges 130*a* and 155*a* overlap.

In operation, and referring back to FIG. 2, the liner hanger 90 is coupled to the running tool 95. Both the liner hanger 90 and the running tool 95 are run downhole within the passageway 80*a* of the casing string 80 when the dog elements are in the retracted position. As the liner hanger 90 and the running tool 95 are lowered to a position in which the ranges 130*a* and 155*a* overlap, the communication devices 130 and 155 communicate and/or energy or data is transferred between the communication devices 130 and 155.

Figure 3:
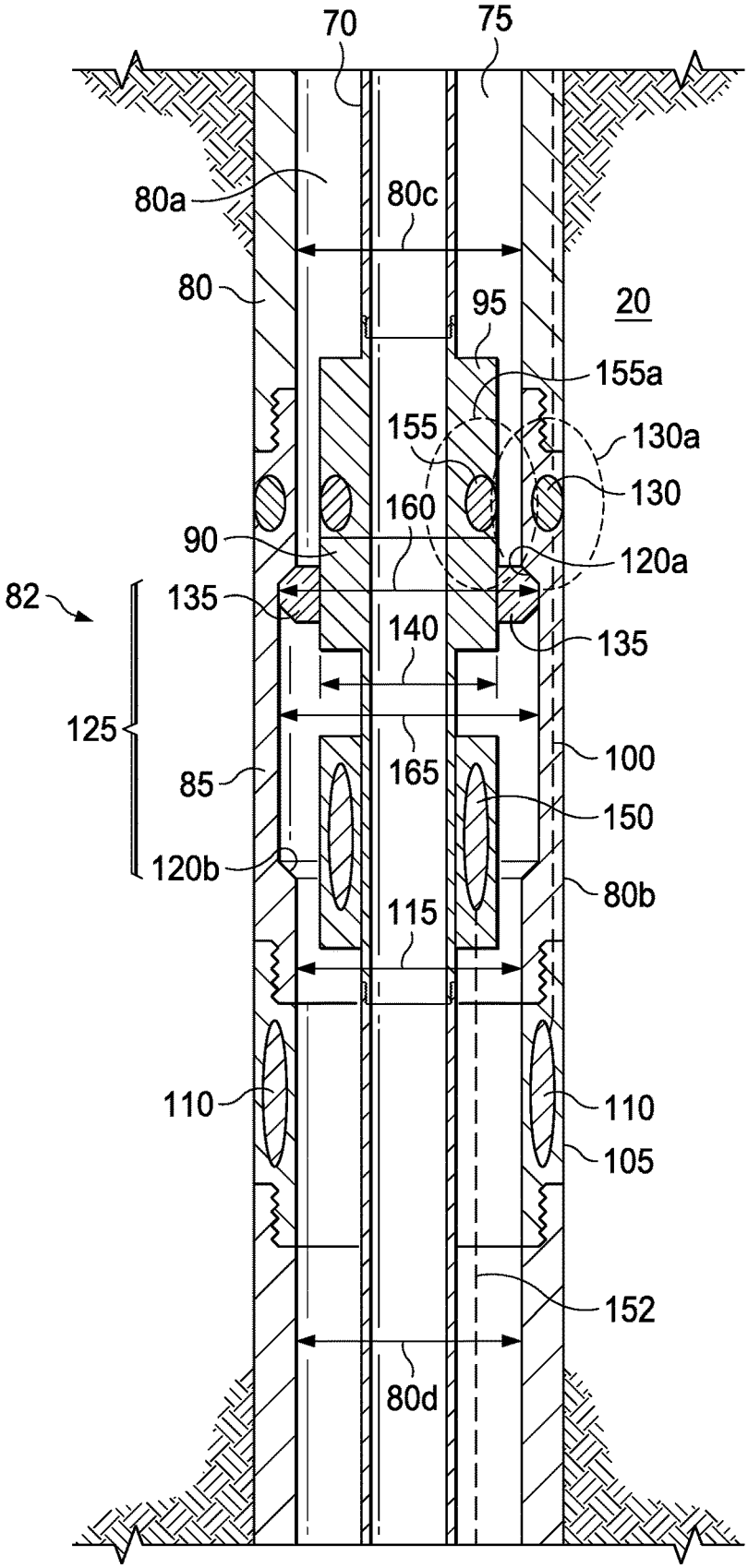
FIG. 3 illustrates a sectional view of the running tool, the intelligent landing profile, and the liner hanger of FIG. 2 in a second configuration, according to one embodiment of the present disclosure.

In one embodiment, when an electric current is transferred between the communication devices 130 and 155 and when the electric current exceeds a predetermined minimum value, the dog elements 135 are extended to the extended position, as illustrated in FIG. 3. FIG. 3 is an illustration of the liner hanger 90 in the extended, unseated position. In one embodiment, and upon or after the electric current transferred between the devices 130 and 155 exceeds the predetermined value, the communication device 155 sends a signal. In one embodiment, the signal is associated with the liner hanger 90 being within or near the enlarged diameter portion 125 of the assembly 85. This signal is sent to the dog elements 135 or a triggering mechanism that is operably coupled to the dog elements 135 and activates or triggers the dog elements 135.

The activation of the dog elements 135 upon the generation of the signal from the communication device 155 and/or 130 can be accomplished in a variety of ways. In one instance, the dog elements 135 can be fully triggered by the electrical power associated with the communication between the devices 130 and 155. In some embodiments, the signal partially triggers the dog elements 135, with additional movement due to power from the liner hanger 90 or the dog elements 135 themselves. For example, the triggering mechanism, such as a spring mechanism or a battery operated solenoid device, could be activated by the initial signal sent by the communication device(s) 130 and/or 155. In some embodiments, the triggering mechanism forms a portion of, or coupled to, the running tool 95. In other embodiments, the triggering mechanism forms a portion of, or is coupled to, the liner hanger 90. In some embodiments, the dog elements 135 can be triggered using either a dedicated control line or one of the control lines 100. For example, in some embodiments, the communication device 130 is operably coupled to the control line 100 that extends to the surface. Once the communication device 155 and the communication device 130 are sufficiently axially aligned and the signal is sent, the communication device 130 sends a signal up the control line 100 to the surface of the well. In response, another trigger signal is sent from the surface of the well to the trigger mechanism to radially expand the dog elements 135. In the expanded position, the outer diameter of the liner hanger 90 is increased from the outer diameter 140 to the outer diameter 145. As shown, the outer diameter 145 (associated with the expanded position) is less than an inner diameter 165 of the enlarged inner diameter portion 125 but greater than the inner diameter 115 of the nipple 85.

Figure 4:
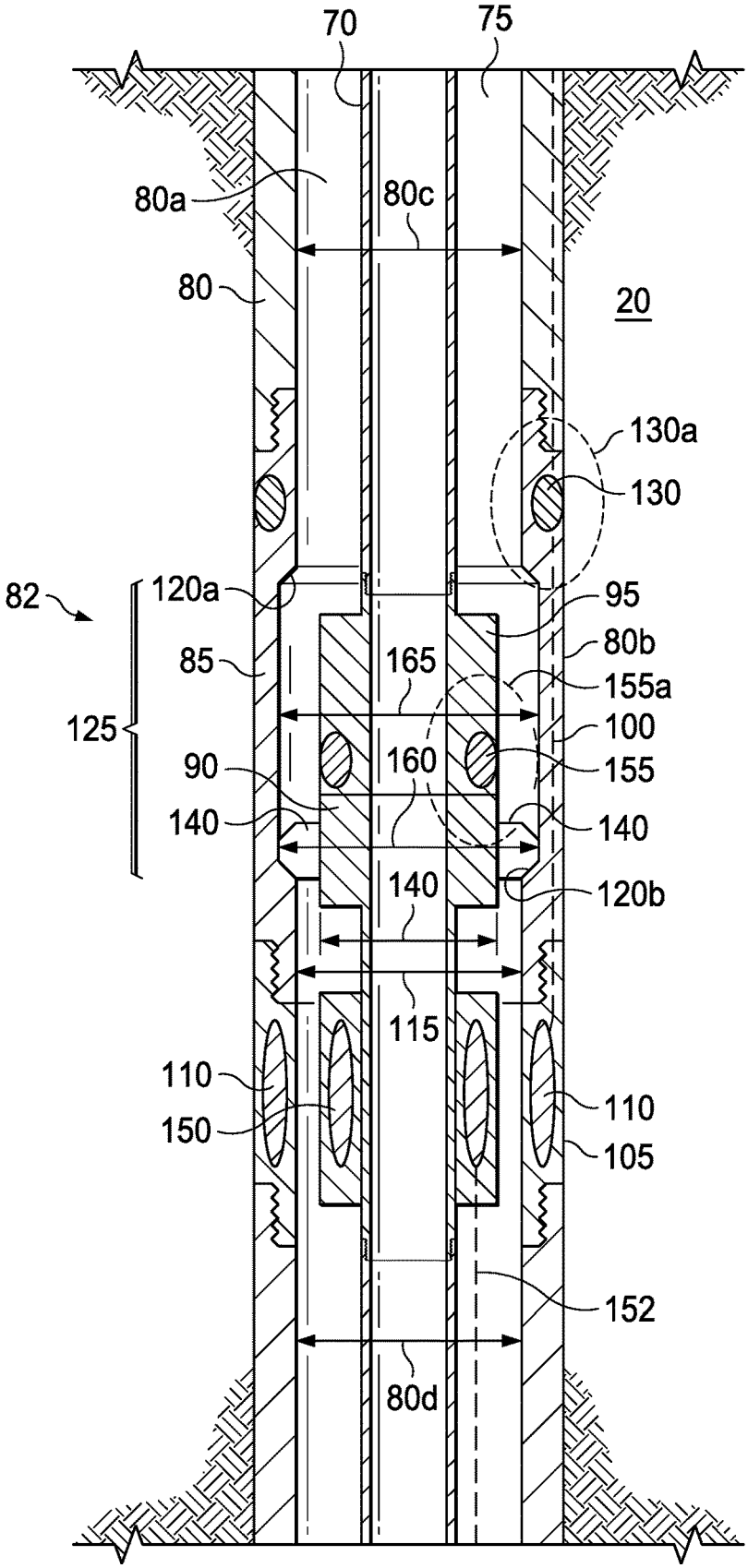
FIG. 4 illustrates a sectional view of the running tool, the intelligent landing profile, and the liner hanger of FIG. 2 in a third configuration, according to one embodiment of the present disclosure.
Figure 5:
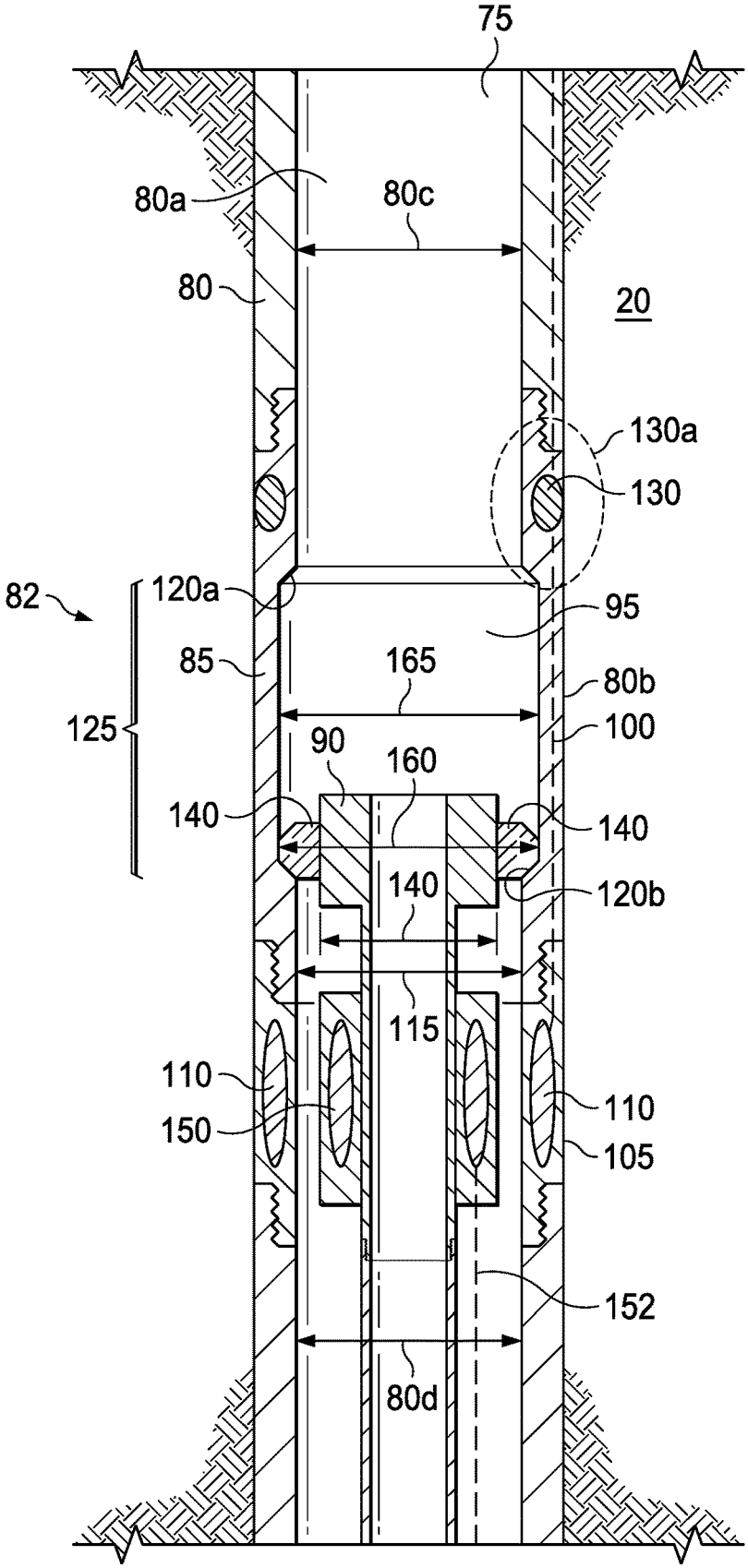
FIG. 5 illustrates a sectional view of the intelligent landing profile and the liner hanger of FIG. 2 in the third configuration, according to one embodiment of the present disclosure.

Due to the radial expansion of the dog elements 135, and upon further lowering of the liner hanger 90, the liner hanger 90 rests on the lowermost shoulder 120*b* of the nipple 85 to form a "No-Go." FIG. 4 is an illustration of the liner hanger 90 in the expanded and seated position. At the No-Go position, the connections 110 and 150 are longitudinally aligned and coupled together. As shown in FIGS. 2-5, the axial dimension or length of the enlarged diameter portion 125 of the assembly 85 is greater than a height or length of the dog elements 135, which may allow for upward movement of the liner hanger 90. Thus, and in some embodiments, the axial dimension of the enlarged diameter portion may be sized to prevent movement in both axial direction (uphole and downhole). However, in some embodiments, the axial dimension of enlarged diameter portion 125 is reduced to prevent upward movement of the liner hanger 90 or at least reduce the amount of upward movement of the liner hanger 90 once the liner hanger 90 is seated on the lowermost shoulder 120*b*. As shown, the communication devices 130 and 155 are axially spaced from each other, and thus not aligned, when the liner hanger is in the expanded and seated position. After the liner hanger 90 is set in the No-Go position, the running tool 95 detaches from the liner hanger 90 and is removed from the wellbore. FIG. 5 is an illustration of the liner hanger 90 in the expanded and seated position with the running tool 95 having been removed from the wellbore 75.

Figure 6:
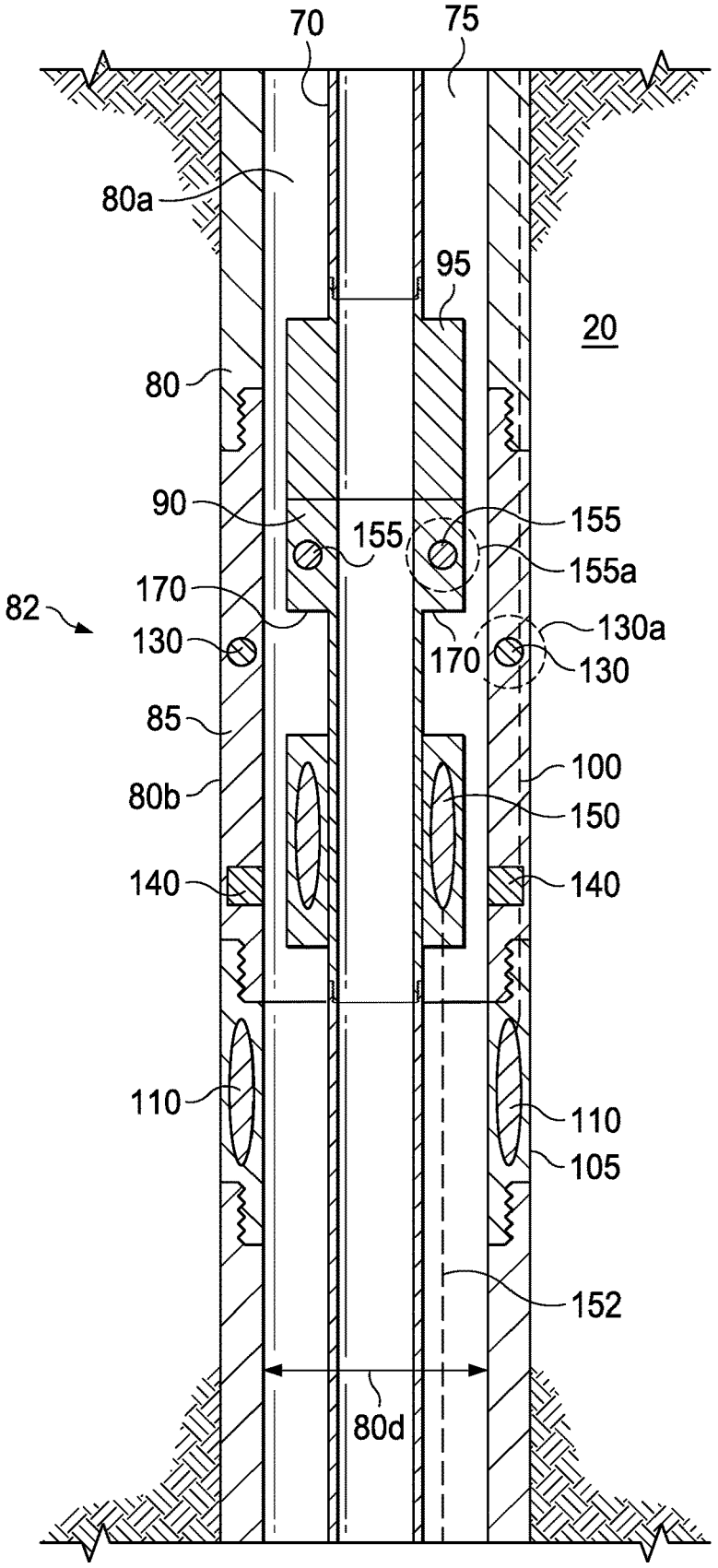
FIG. 6 illustrates a sectional view of the running tool, the intelligent landing profile, and the liner hanger of FIG. 1 in a first configuration, according to another exemplary embodiment of the present disclosure.
Figure 7:
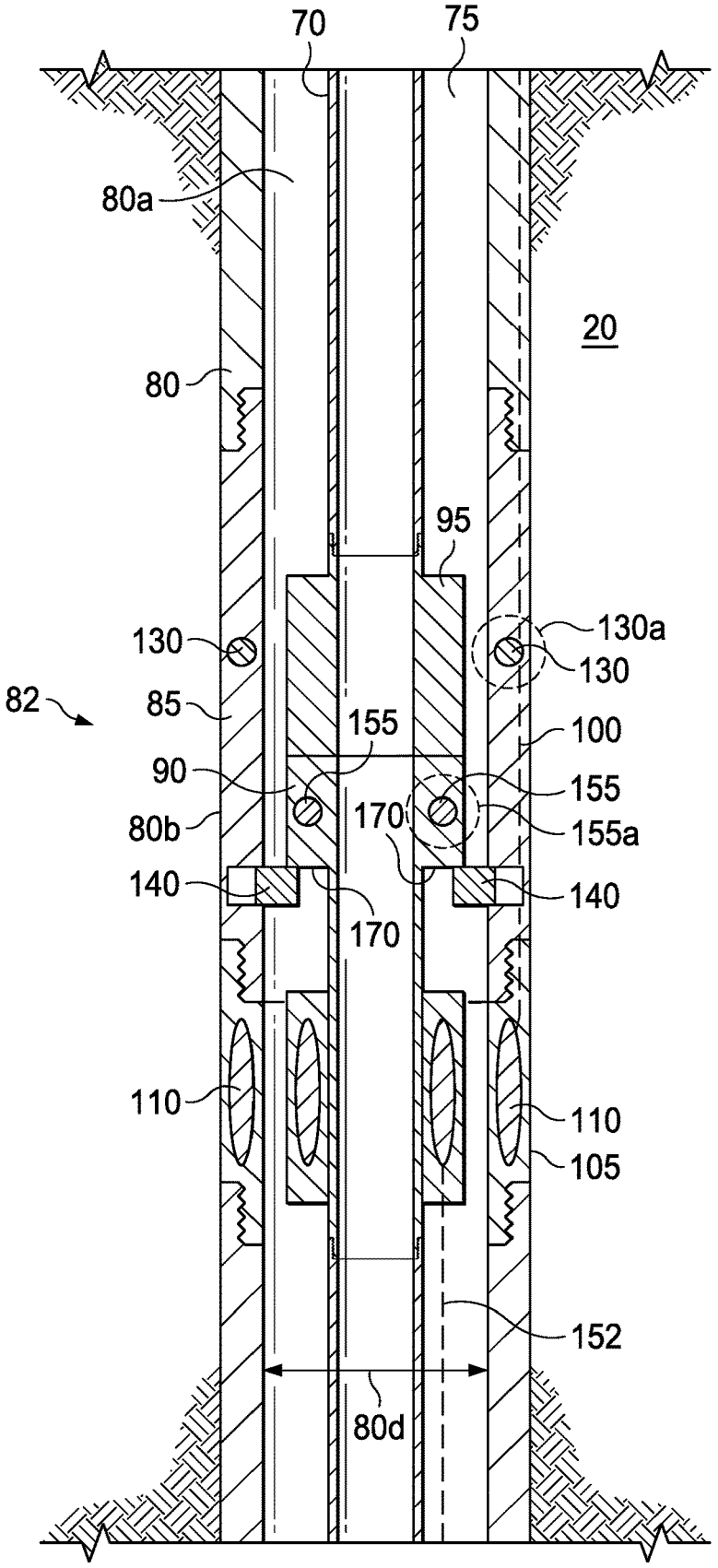
FIG. 7 illustrates a sectional view of the running tool, the intelligent landing profile, and the liner hanger of FIG. 6 in a second configuration, according to one embodiment of the present disclosure.

The intelligence landing assembly 82 can be altered in a variety of ways. In some embodiments, the dog elements 135 can be omitted from the liner hanger 90 and instead, any variety of actuating elements can be used, such as slips, a C-ring, balls, or other means. Moreover, and as shown in FIGS. 6 and 7, the nipple 85 includes the dog elements 135, which extend radially inward into the passageway 80*a*, while the liner hanger 90 forms an outwardly extending shoulder or radially-extending surface 170. In some instances, the surface 170 is spaced longitudinally from the connections 150. Thus, the dog elements 135 can extend radially inwardly from the nipple 85 to form the No-Go with the surface 170 resting on the extended dog elements 135. When the dog elements 135 are retracted within the wall of the nipple 85, the inner diameter of the nipple 85 defined by the dog elements 135 is less than or equal to the diameter 80*c* and 80*d*. Moreover, and as shown in FIGS. 6 and 7, the communication device 155 may be omitted from the running tool 95 and instead be located within the liner hanger 90.

As described, the intelligent landing assembly 82 does not require a fixed No-Go. Instead, the intelligent landing assembly 82 provides a No-Go when the liner hanger 90 is at the desired position, which is predetermined based on the type of intelligent system run (e.g., electric, hydraulic, fibre optic, inductive coupling, other energy transfer mechanism, etc.). Thus, the intelligent landing assembly 82 optimally positions the connection 150, which may be a wet-connect, relative to the connection 110 without having to rotate or to pass a landing profile and pull back to set. In some embodiments, the intelligent landing assembly 82 uses the existing power from the control line 100 to trigger the No-Go in either the intelligent landing assembly 82 or the tool to be landed (e.g., the liner hanger 90), or a combination of both. In some instances, the intelligent landing assembly 82 provides some of the power to trigger and/or set the dog element 135 in addition to the control line 100. In some embodiments, one or more types of power (e.g., hydraulic and electrical) is used to trigger and/or set the intelligent landing assembly 82. The No-Go (i.e., the dog element 135) can also be reset when the tool 90 is removed from the intelligent landing assembly 82. The enlarged inner diameter portion 125 of the intelligent landing assembly 82 has a simpler, smoother ID than conventional landing assemblies, which makes it easier to clean, with no geometry which would collect debris or cement. The intelligent landing assembly 82 provides for a means to accurately position a wet-connect which then provides for a strong signal for controlling downhole intelligent sensors, valves, etc. Moreover, the control line 100 can communicate to the surface of the well that the dog element 135 have been deployed and that the liner hanger 90 has landed correctly. The control line 100 used to trigger the mechanism can be the same as one that provides other benefits (i.e. used to control a valve). As the interior profile of the intelligent landing assembly 82 is simple and smooth, cement and other debris does not cling to it during cleaning operations. When the tool (the liner hanger 90 or other) is removed, the No-Go (i.e., the dog element 135) can retract providing a casing drift ID similar to the casing drift ID prior to installation of the liner hanger 90.

In some embodiments, the casing 80 may be omitted from the intelligent landing assembly 82 and replaced with any type of tubing or tubular and the liner hanger 90 may be omitted and replaced with any type of downhole tool.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Thus, a method for securing a downhole assembly to a casing string disposed within a wellbore has been described. Embodiments of the method may generally include moving, in a first direction, at least a portion of the downhole assembly within a passageway of a landing nipple that forms a portion of the casing string; exchanging a signal between a first communication device that is coupled to the downhole assembly and a second communication device that forms a portion of the nipple; and preventing further movement of the downhole assembly, relative to the nipple, in the first direction in response to the exchange of the wireless signal and when the first communication device is spaced from the second communication device in the first direction. For any of the foregoing embodiments, the method may include any one of the following, alone or in combination with each other:

The downhole assembly includes a liner hanger that is coupled to a running tool; and wherein the liner hanger includes the first communication device.

Preventing further movement of the downhole assembly, relative to the nipple, in the first direction includes extending, in a radially outward direction from the downhole assembly, a radially extendable arm that increases an outer diameter of the downhole assembly; and resting the radially extendable arm on a shoulder that defines a recess within the landing nipple to prevent further movement of the downhole assembly, relative to the landing nipple, in the first direction.

The casing string includes a first casing coupled to the landing nipple and a second casing coupled to the landing nipple, wherein the landing nipple is positioned between the first casing and the second casing, wherein the first casing defines a first inner diameter and the second casing string defines a second inner diameter, wherein the recess within the landing nipple defines an inner diameter that is greater than each of the first inner diameter and the second inner diameter.

Preventing further movement of the downhole assembly, relative to the nipple, in the first direction includes extending, from a retracted position in which an inwardly radially extendable arm is positioned within a wall of the landing nipple, the arm in a radially inward direction to decrease an inner diameter of the landing nipple; and resting a surface of the downhole assembly on the radially extendable arm to prevent further movement of the downhole assembly relative to the landing nipple in the first direction.

The radially extendable arm is selected from the group consisting of one or more slips, one or more C-rings, one or more dogs, and one or more balls.

The portion of the downhole assembly is selected from the group consisting of a liner hanger, a packer, tubing hanger, artificial lift equipment, tubing anchor, and a whipstock.

The casing string includes a first casing coupled to the landing nipple and a second casing coupled to the landing nipple, wherein the landing nipple is positioned between the first casing and the second casing, wherein the first casing defines a first inner diameter and the second casing defines a second inner diameter, wherein when the radially extendable arm is in the retracted position, the inner diameter of the nipple is less than or equal to each of the first inner diameter and the second inner diameter.

Each of the first and second communication devices is an inductive coupler.

The downhole assembly includes a first control line terminating in a first connection; wherein the landing nipple includes a second control line terminating in a second connection; and wherein resting the radially extendable arm on the shoulder couples the first connection with the second connection to operably couple the first control line with the second control line.

Thus, a landing system has been described. In one embodiment, the landing system includes a tubular landing nipple forming a longitudinally extending, annular recess within an interior wall of the landing nipple; a first wireless communication device having a first transmission range positioned within the wall of the landing nipple; a downhole assembly including a radially extendable arm configured to extend within the annular recess of the landing nipple; and a second wireless communication device having a second transmission range that is configured to overlap the first transmission range, wherein the radially extendable arm is configured to extend within the recess of the landing nipple in response to the overlapping of the first transmission range and the second transmission range; and wherein, when the radially extendable arm rests on the shoulder, the first communication device is axially spaced from the second communication device. For any of the foregoing embodiments, the system may include any one of the following, alone or in combination with each other:

The recess is at least partially defined by a shoulder formed within the wall; and wherein the radially extendable arm rests on the shoulder formed within the wall to prevent movement of the downhole assembly relative to the nipple.

The tubular landing nipple forms a portion of a casing string that is cemented to a wall of a wellbore.

The downhole assembly is a liner hanger that is coupled to a running tool; and wherein either the liner hanger or the running tool includes the second wireless communication device.

The tubular landing nipple further includes a first control line connection from which a first control line extends; and wherein the downhole assembly further includes to a second control line connection from which a second control line extends; wherein, when in the radially extendable arm rests on the shoulder, the first control line connection couples with the second control line connection to operably couple the first control line with the second control line.

Each of the first and second communication devices is an inductive coupler.

Thus, a landing system has been described. In one embodiment, the landing system includes a tubular landing nipple including: a radially extendable arm that is extendable in an inwardly radial direction; and a first wireless communication device having a first transmission range; a downhole assembly including a radially extending surface configured to rest on the extended arm of the landing nipple; and a second wireless communication device having a second transmission range that is configured to overlap the first transmission range, wherein the radially extendable arm is configured to extend in response to the overlapping of first transmission range and the second transmission range; and wherein, when in the radially extending surface rests on the radially extendable arm, the first communication device is axially spaced from the second communication device. For any of the foregoing embodiments, the system may include any one of the following, alone or in combination with each other:

The tubular landing nipple further includes a first control line connection from which a first control line extends; and wherein the downhole assembly further includes to a second control line connection from which a second control line extends; wherein, when in the radially extending surface rests on the radially extendable arm, the first control line connection couples with the second control line connection to operably couple the first control line with the second control line.

Each of the first and second communication devices is an inductive coupler.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

What is claimed is:

1. A method for securing a downhole assembly to a casing string disposed within a wellbore, the method comprising:

moving, in a first direction, at least a portion of the downhole assembly within a passageway of a landing nipple that forms a portion of the casing string;

exchanging a wireless signal between a first communication device that is coupled to the downhole assembly and a second communication device that forms a portion of the nipple; and preventing further movement of the downhole assembly, relative to the nipple, in the first direction in response to the exchange of the wireless signal and when the first communication device is spaced from the second communication device in the first direction.

2. The method of claim 1, wherein the downhole assembly comprises a liner hanger that is coupled to a running tool; and wherein the liner hanger comprises the first communication device.

3. The method of claim 1, wherein the downhole assembly comprises a liner hanger that is coupled to a running tool; and wherein the running tool comprises the first communication device.

4. The method of claim 1, wherein preventing further movement of the downhole assembly, relative to the nipple, in the first direction comprises:

extending, in a radially outward direction from the downhole assembly, a radially extendable arm that increases an outer diameter of the downhole assembly; and resting the radially extendable arm on a shoulder that defines a recess within the landing nipple to prevent further movement of the downhole assembly, relative to the landing nipple, in the first direction.

5. The method of claim 4, wherein the casing string comprises a first casing coupled to the landing nipple and a second casing coupled to the landing nipple, wherein the landing nipple is positioned between the first casing and the second casing, wherein the first casing defines a first inner diameter and the second casing string defines a second inner diameter, wherein the recess within the landing nipple defines an inner diameter that is greater than each of the first inner diameter and the second inner diameter.

6. The method of claim 4, wherein the radially extendable arm is selected from the group consisting of one or more slips, one or more C-rings, one or more dogs, and one or more balls.

7. The method of claim 4, wherein the downhole assembly comprises a first control line terminating in a first connection; wherein the landing nipple comprises a second control line terminating in a second connection; and wherein resting the radially extendable arm on the shoulder couples the first connection with the second connection to operably couple the first control line with the second control line.

8. The method of claim 1, wherein preventing further movement of the downhole assembly, relative to the nipple, in the first direction comprises:

extending, from a retracted position in which an inwardly radially extendable arm is positioned within a wall of the landing nipple, the arm in a radially inward direction to decrease an inner diameter of the landing nipple; and resting a surface of the downhole assembly on the radially extendable arm to prevent further movement of the downhole assembly relative to the landing nipple in the first direction.

9. The method of claim 8, wherein the casing string comprises a first casing coupled to the landing nipple and a second casing coupled to the landing nipple, wherein the landing nipple is positioned between the first casing and the second casing, wherein the first casing defines a first inner diameter and the second casing defines a second inner diameter, wherein when the radially extendable arm is in the retracted position, the inner diameter of the nipple is less than or equal to each of the first inner diameter and the second inner diameter.

10. The method of claim 1, wherein the portion of the downhole assembly is selected from the group consisting of a liner hanger, a packer, tubing hanger, artificial lift equipment, tubing anchor, and a whipstock.

11. The method of claim 1, wherein each of the first and second communication devices is an inductive coupler.

12. A landing system, comprising:

a tubular landing nipple forming a longitudinally extending, annular recess within an interior wall of the landing nipple;

a first wireless communication device having a first transmission range positioned within the wall of the landing nipple;

a downhole assembly comprising a radially extendable arm configured to extend within the annular recess of the landing nipple; and a second wireless communication device having a second transmission range that is configured to overlap the first transmission range, wherein the second wireless communication device is coupled to the downhole assembly;

wherein the radially extendable arm is configured to extend within the recess of the landing nipple in response to the overlapping of the first transmission range and the second transmission range; and wherein the recess is at least partially defined by a shoulder formed within the wall and, when the radially extendable arm rests on the shoulder, the first communication device is axially spaced from the second communication device.

13. The landing system of claim 12, wherein the radially extendable arm rests on the shoulder formed within the wall to prevent movement of the downhole assembly relative to the nipple.

14. The landing system of claim 13, wherein the tubular landing nipple forms a portion of a casing string that is cemented to a wall of a wellbore.

15. The landing system of claim 13, wherein the tubular landing nipple further comprises a first control line connection from which a first control line extends; and wherein the downhole assembly further comprises to a second control line connection from which a second control line extends;

wherein, when the radially extendable arm rests on the shoulder, the first control line connection couples with the second control line connection to operably couple the first control line with the second control line.

16. The landing system of claim 12, wherein the downhole assembly is a liner hanger that is coupled to a running tool; and wherein either the liner hanger or the running tool comprises the second wireless communication device.

17. The landing system of claim 12, wherein each of the first and second communication devices is an inductive coupler.

18. A landing system, comprising:

a tubular landing nipple comprising:

a radially extendable arm that is extendable in an inwardly radial direction; and a first wireless communication device having a first transmission range;

a downhole assembly comprising a radially extending surface configured to rest on the extended arm of the landing nipple; and a second wireless communication device having a second transmission range that is configured to overlap the first transmission range, wherein the second wireless communication device is coupled to the downhole assembly;

wherein the radially extendable arm is configured to extend in response to the overlapping of first transmission range and the second transmission range; and wherein, when in the radially extending surface rests on the radially extendable arm, the first communication device is axially spaced from the second communication device.

19. The landing system of claim 18, wherein the tubular landing nipple further comprises a first control line connection from which a first control line extends; and wherein the downhole assembly further comprises to a second control line connection from which a second control line extends;

wherein, when in the radially extending surface rests on the radially extendable arm, the first control line connection couples with the second control line connection to operably couple the first control line with the second control line.

20. The landing system of claim 18, wherein each of the first and second communication devices is an inductive coupler.

* * * * *